United States Patent [19]

Poortman

[11] 4,000,904

[45] Jan. 4, 1977

[54] TEE OFF DEVICE

[76] Inventor: Karel Arnold Poortman, De Brei 4, Ingen, Netherlands

[22] Filed: June 26, 1975

[21] Appl. No.: 590,689

[30] Foreign Application Priority Data

July 4, 1974 Netherlands ..... 7409067

[52] U.S. Cl. ..... 273/183 A; 273/183 E; 273/184 R; 273/186 C; 273/195 R

[51] Int. Cl.[2] ..... A63B 69/36

[58] Field of Search ..... 273/183 A, 184 R, 183 R, 273/26 A, 26 R, 26 E, 183 E, 184 B, 186 B, 186 C, 186 R, 195 R

[56] References Cited

UNITED STATES PATENTS

| | | | |
|---|---|---|---|
| 1,596,110 | 8/1926 | Lynch | 273/183 A |
| 2,903,820 | 9/1959 | Bodell | 273/58 G X |
| 3,436,076 | 4/1969 | Barthol | 273/183 R X |
| 3,580,575 | 5/1971 | Speeth | 273/58 G |

*Primary Examiner*—George J. Marlo
*Attorney, Agent, or Firm*—Steinberg & Blake

[57] ABSTRACT

A golf-ball tee-off device for training a golfer to keep his body stationary when teeing-off a ball. The device includes a teeing platform which is caused to move downward in response to the weight of a tee and golf ball thereon. Downward movement of the platform actuates a device which causes continuous rotation of a gear including a circular array of light transmitting windows of different colors.

When the golf ball is driven from the platform, mechanism is provided to cause the platform to be raised to its elevated position and halt the rotation of the gear, while producing a momentary light under one of the light transmitting windows, the color of which can be observed by the golfer if his eyes were retained on the golf ball for the proper time period.

3 Claims, 2 Drawing Figures

TEE OFF DEVICE

The present invention concerns a tee-off device for golf balls. Tee-off devices are known in many types and variations.

When using a tee-off device, the following procedure is followed: the golf ball is laid on the mostly cup-shaped top end of the tee-off device, whose conical or pin-shaped lower end, is inserted in the ground, and subsequently the ball is teed off by the golfer with a golf club. A frequent error, however, is that the golfer, when teeing off the ball, does not watch the ball sufficiently long, viz. not until the moment of the stroke but already before hitting the ball will raise his head, to follow the path of the ball, as a result of which the stroke is often not accurate because when raising his head the position of the shoulders is changed, so that the golf club hits the ball differently than was the intention upon initiating the forward swing. It is an object of the present invention to provide a tee-off device enabling the golfer to check himself whether he has kept his eyes long enough on the ball when performing a stroke, during which the golfer himself cannot only determine whether he executes the stroke incorrectly but also receives a positive indication if the performance of the stroke is correct.

According to the present invention there is provided a tee-off device, particularly suitable for use in golf playing, characterized by means adapted to emit a flash of light of one of a number of available colours as soon as a golf ball is teed off.

Figure 1:
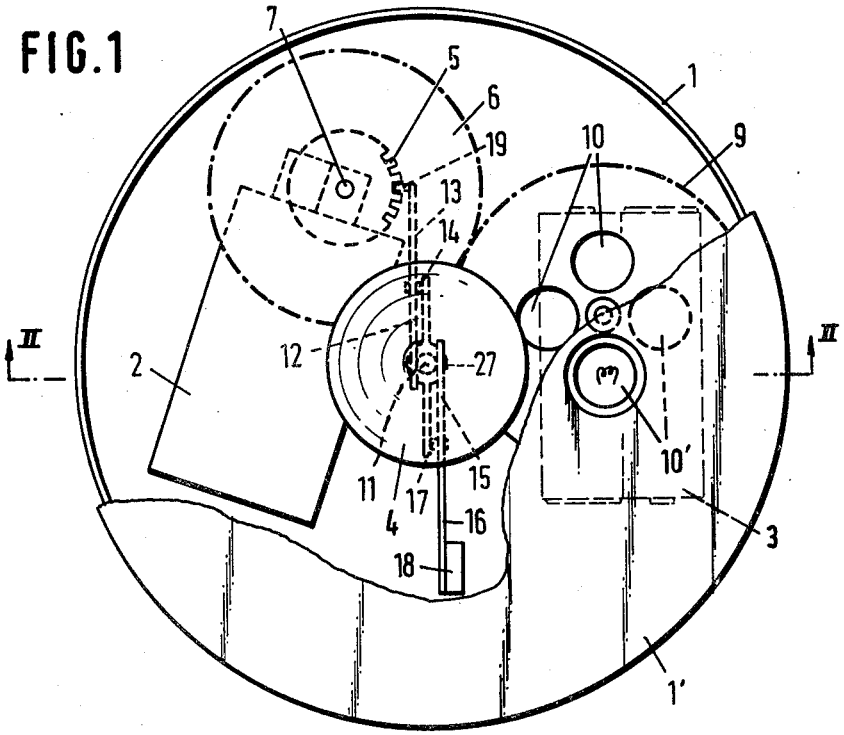
Figure 2:
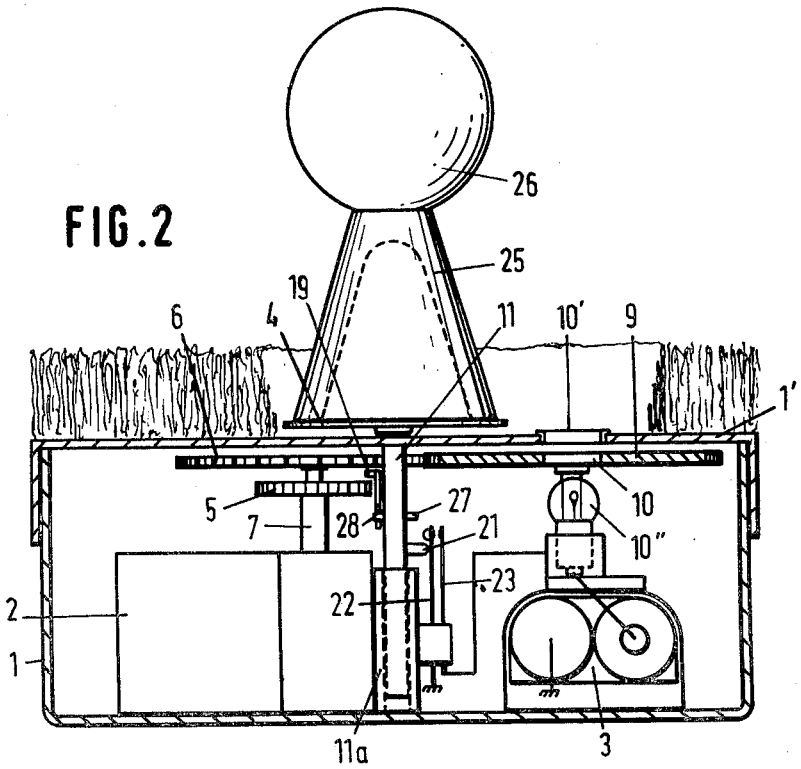

One embodiment of the device according to the invention will now be described, by way of example, with reference to the accompanying drawings, wherein FIG. 1 is a top view wherein some parts of the device according to the invention have been removed for clarity;

FIG. 2 shows a cross-section on the line II—II of FIG. 1, also depicting a rubber tee and a golf ball.

FIG. 1 shows a housing 1 which is preferably of cylindrical shape, with the same diameter as the bore present on any golf-links for boring a "hole". The housing 1 is fully covered at the top by a cover plate 1′ through which extends a shaft 11 which is provided at the top with a platform 4 (FIG. 2) serving for supporting a loose, preferably frusto-conical supporting member(-tee) 25 on which a golf ball 26 can be laid.

The housing accommodates an electrical or mechanical drive mechanism 2 for a vertical shaft 7. On shaft 7 there is mounted a substantially horizontal wheel 5 having teeth or recesses and superimposed thereon on the same shaft 7 a gear 6 which is in engagement with a likewise horizontal gear 9. In the gear 9 there is disposed a plurality of differently coloured light-transmitting windows 10 which are adapted to rotate underneath an opening 10′ in the cover plate 1′. Underneath the opening in said cover plate and underneath the level of the rotating windows 10 there is a lamp 10″ fed by a battery 3. Connected to shaft 11, which is slidable up and down but not rotatable in a guide 11*a* (FIG. 2), is a lever 15, 16 which is adapted for swinging or pivoting movement about a fixed horizontal shaft or pin 17 carried by a stationary arm fixed, for example, to the guide 11*a*. Lever 15 is provided at the end 16 with a weight 18. The opposite end 15 of lever 15 is provided with a longitudinal slot receiving a cam or pin 27 on the shaft 11. The weight 18 and the lever ratio 15/16 are so chosen that when a golf ball is laid on the supporting member, the platform 4 and the shaft 11 are moved downwardly a specific distance. The weight of the lightest type of golf ball together with that of the lightest tee should be sufficient for lowering the platform 4., while the heaviest tee alone (i.e. without a golf ball) must not produce a downward movement of the shaft 11 with the platform 4. Upon such downward movement a cam or pin 28 mounted on the shaft 11 is received in a slot at one end of a lever 12, 13, swings the lever 12, 13 about a fixed horizontal shaft or pin 14 in a vertical plane this stationary pin 14 also being carried, for example, by an arm which is fixed to and extends from the guide 11*a*. The end 13 is provided with a cam 19 normally falling between the teeth or into recesses of the wheel 5, but upon a downward motion of the shaft 11 with the platform 4 is lifted from the teeth or recesses of the wheel 5. The wheel 5 and the gear 6 can then be rotated through the drive mechanism 2 via shaft 7, thereby entraining the gear 9 with the coloured windows so that each time a different window 10 is introduced between the lamp 10″ and the opening 10′ in the cover plate 1′.

The moment when the ball is teed off, the shaft 11 with the platform, whereon, under certain circumstances, the tee may have remained, under the influence of weight 18 is moved upwardly through the lever 15, 16, the pin 28 mounted on the shaft 11 so operating the lever 12, 13 that the cam 19 falls in between teeth or into recesses of the wheel 5. The gear 6 and the gear 9 are then arrested because the gear 6 is fixedly coupled through shaft 7 to the wheel 5. At the same time, during upward movement of shaft 11 by means of a cam 21 fixed thereto (FIG. 2), a resilient contact member 22 is contacted with a stationary contact member 23, thus closing the electric circuit between the accumulator 3 and the lamp 10″, so that the lamp lights up and the golfer can perceive a light signal, whose colour depends on the window being at that moment before the opening 10′ in the cover plate 1′. The cam 21 and the contact member 22 are so positioned that the contact between the resilient contact member 22 and the other contact member 23 is only of short duration while cam 21 moves up past the button at the top end of switch blade 22, so that the lamp emits a light flash.

The object now is that the golfer keeps looking at the device for such period of time that, when teeing off the ball, he will be able to tell the colour of the light flash produced. In this manner the golfer can, in a simple manner, get used to keep looking at the ball long enough, which will result in a better stroke. Checking is possible because, after tee off, the platform 4 can be lowered by hand so far that the lamp will light up with the drive mechanism still being in rest.

The device as described above can be extended or modified for practical use in various ways. For instance the housing 1 may be provided with a flange by means of which the device can be suspended at a proper height in a hole in the ground. However, also suitable hooks can be used for this purpose, which on the one end support the bottom or a flange of the housing, and on the other end bear on the ground adjacent the hole. These hooks may be collapsible.

Furthermore when use is made of a mechanical drive mechanism, means may be provided at the bottom of the device for winding up said mechanism.

The above-described levers and cams may be constructed in various ways by appropriate techniques.

Also, the weight 18 and possibly the entire lever 15, 16 may be replaced by a spring having the same effect.

The different types of conventional, commercially available rubber tees, lying loose on the platform, are preferably provided with a cord having a pin attached thereto, which can be inserted in the ground, thus preventing loss of the supporting members. The tees are additionally supplied in different lengths so as to comply with the individual wishes of each golfer.

Furthermore there may be disposed on the cover plate, for completing the tee-off device, an artificial turf having an opening adjacent the platform 4 and the opening in the cover plate along which the windows 10 rotate. In order that at the moment of the light flash the relative window is not in register with the opening in the cover plate, it is possible to apply, instead of the gear assembly 6, 9, a transmission having discrete teeth such as a maltese cross transmission.

The above modifications are within the reach of one skilled in the art and should therefore be deemed to lie within the scope of the present invention.

I claim:

1. A tee-off device comprising a housing having an upper wall formed with a pair of openings passing therethrough and said housing also having a lower wall situated below said upper wall to define therewith an interior space in said housing, a rotary disc situated in said housing adjacent said upper wall thereof and carrying a plurality of transparent members of different colors for movement past one of said openings while said rotary disc rotates, drive means situated in said housing and operatively connected with said disc for rotating the latter, a lamp situated beneath said disc in said housing in alignment with said one opening at said upper wall of said housing for directing light through one of said transparent members when said lamp is illuminated, circuit means operatively connected to said lamp for illuminating the latter and including a switch for closing said circuit means to illuminate said lamp when said switch is closed, a shaft extending through the other of said openings of said upper wall of said housing carrying above said housing a platform on which a tee with a golf ball thereon is adapted to rest, guide means situated in said housing and supporting said shaft for vertical movement, said switch being located adjacent said shaft and the latter carrying a cam for closing said switch during vertical movement of said shaft, urging means situated in said housing and operatively connected with said shaft for urging the latter to an upper position when a golf ball is not carried by a tee on said platform, said urging means responding to placing of a golf ball on a tee on the platform to free the shaft for downward movement to a lower position, said cam operating said switch to illuminate said lamp during upward movement of said shaft when a golf ball is displaced from a tee on the platform, and arresting means situated in said housing and operatively connected with said shaft for cooperating with said drive means to arrest the operation thereof when said shaft moves upwardly in response to the force of said urging means upon removal of a golf ball from a tee, so that light of a given color will flash through said one opening in said upper wall of said housing to be visible to a golfer when a golf ball is driven from a tee on the platform.

2. The combination of claim 1 and wherein said urging means is in the form of a lever supported for pivotal movement between its ends, formed at one end with a slot, said shaft carrying a pin received in said slot, and said lever carrying at an end distant from said pin a weight which together with said lever urges said shaft to its upper position when a ball is not on a tee on the platform while responding to the weight of a ball for permitting the shaft to move downwardly further into the housing.

3. The combination of claim 1 and wherein said arresting means is in the form of a lever supported for pivotal movement intermediate its ends and formed at one end with a slot, said shaft carrying a pin received in the latter slot, and said lever having a projection at an end distant from the latter pin, said drive means including a gear receiving said projection when said urging means urges said shaft to its upper position, so that said projection cooperates with said gear to terminate the operation of said drive means.

* * * * *